US009609453B2

(12) United States Patent
Jabri

(10) Patent No.: US 9,609,453 B2
(45) Date of Patent: Mar. 28, 2017

(54) METHOD AND APPARATUS FOR CONTROLLING MULTIMEDIA EXECUTION ON A DEVICE

(71) Applicant: Abdulrahman Al Jabri, Riyadh (SA)

(72) Inventor: Abdulrahman Al Jabri, Riyadh (SA)

( * ) Notice: Subject to any disclaimer, the term of this patent is extended or adjusted under 35 U.S.C. 154(b) by 156 days.

(21) Appl. No.: 14/596,821

(22) Filed: Jan. 14, 2015

(65) Prior Publication Data

US 2016/0205489 A1 Jul. 14, 2016

(51) Int. Cl.
*H04S 5/00* (2006.01)

(52) U.S. Cl.
CPC ..... *H04S 5/00* (2013.01)

(58) Field of Classification Search
CPC ... H04S 5/00; H04S 7/00; H04S 7/307; A61B 5/04845; A61B 5/486; G10H 2210/076
USPC ..... 381/58, 98, 56
See application file for complete search history.

(56) References Cited

U.S. PATENT DOCUMENTS 5,213,562 A * 5/1993 Monroe ..... A61B 5/0482 600/28
8,552,860 B2 * 10/2013 Baughman ..... A61B 5/04845 340/540
9,191,764 B2 * 11/2015 Baughman ..... A61B 5/04845
2008/0215170 A1 * 9/2008 Milbrandt ..... G06F 17/30749 700/94
2014/0350927 A1 * 11/2014 Yamabe ..... G10L 21/0232 704/233

* cited by examiner

*Primary Examiner* — Vivian Chin
*Assistant Examiner* — Jason R Kurr
(74) *Attorney, Agent, or Firm* — Ditthavong & Steiner, P.C.

(57) ABSTRACT

Embodiments are disclosed for controlling execution of multimedia data. One or more information blocks of multimedia data including audio sounds are determined. Also, one or more frequency differences in the audio sounds for each of the one or more information blocks of the audio data is determined. The control of the execution of the multimedia data is based, at least in part on, a comparison of the one or more frequency differences to one or more prestored frequency values.

18 Claims, 8 Drawing Sheets

METHOD AND APPARATUS FOR CONTROLLING MULTIMEDIA EXECUTION ON A DEVICE

BACKGROUND

Music has been used since long to provide entertainment and even relaxation. Generally, there are types of music available that are categorized as digital drugs or binaural beats and provide effects similar to taking a psychoactive drug (e.g., smoking, drinking, inhaling, or injecting of drugs such as marijuana, cocaine etc.).

These digital drugs or binaural beats rely on the frequencies of brain waves that can induce such effects. Brain works different frequency ranges, for example, "Gamma" relates to frequencies that are greater than 40 Hz, and are relevant to higher mental activity, perception, problem solving, fear, and consciousness. Similarly, "Beta" (i.e., frequencies between 13 Hz and 39 Hz) are relevant to active, busy or anxious thinking, active concentration, arousal, cognition, and/or paranoia; "Alpha" (i.e., frequencies between 7 Hz and 13 Hz) are relevant to alert relaxation; "Theta" (i.e., frequencies between 4 Hz to 7 Hz) are relevant to deep relaxation and increased learning, and "Delta" relates to frequencies less than 4 Hz and are relevant to deep sleep.

Brainwave entrainment happens when an external frequency is provided that stimulates an effect (for example, to induce sleep). The sensation of binaural beats occurs when two coherent sounds of nearly similar frequencies are presented one to each ear with stereo headphones or speakers For example, if a frequency of 300 Hz is played in one ear and 307 Hz is played in the other ear, a binaural beat of 7 Hz is created in the brain. This frequency lies in the "Alpha" frequency that induces brain relaxation, as noted above. While, the binaural beats are generally intended for useful or medicinal purposes (e.g., by neurologists), these binaural beats may be harmful under several conditions. For example, the binaural beats may be harmful for people who have problems with seizures, individuals involved in any kind of activity where falling asleep could be harmful (such as working with heavy machinery or cooking), children, pregnant women, people who suffer from heart problems or use a pacemaker.

Therefore, techniques are desired for controlling execution of multimedia on a device.

SOME EXAMPLE EMBODIMENTS

Embodiments of the invention provide a method for controlling execution of multimedia. The method comprises determining one or more information blocks of multimedia data, wherein the multimedia data includes audio sounds. Further, the method comprises determining one or more frequency differences in the audio sounds for each of the one or more information blocks of the audio data. The method also comprises controlling the execution of the multimedia data based, at least in part on, a comparison of the one or more frequency differences to one or more prestored frequency values.

Embodiments of the invention provide an apparatus for controlling execution of multimedia. The apparatus comprising a processor and a memory coupled with the processor, wherein the memory comprises one or more instructions that cause the processor to perform at least: determine one or more information blocks of multimedia data, wherein the multimedia data includes audio sounds. The apparatus is also caused to determine one or more frequency differences in the audio sounds for each of the one or more information blocks of the audio data. The apparatus is further caused to control the execution of the multimedia data based, at least in part on, a comparison of the one or more frequency differences to one or more prestored frequency values.

Embodiments of the invention provide a method for controlling execution of multimedia. The method comprises capturing multimedia data over a plurality of capture windows of a predefined time interval to generate one or more information blocks associated with the multimedia data, wherein the multimedia data includes audio sounds. The method also comprises processing the audio sounds of the multimedia data to generate a plurality of stereo sound waves associated for each of the one or more information blocks. Further, the method comprises determining one or more frequency differences in the stereo sound waves for each of the one or more information blocks of the multimedia data. Also, the method comprises determining one or more binaural beat parameters based, at least in part, on the one or more frequency differences in the stereo sound waves for each of the one or more information blocks. Further, the method comprises controlling the execution of the multimedia data based, at least in part on, a comparison of the one or more binaural beat parameters to one or more prestored beat values.

Other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings.

DESCRIPTION OF SOME EMBODIMENTS

Illustrative embodiments of the invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1A:
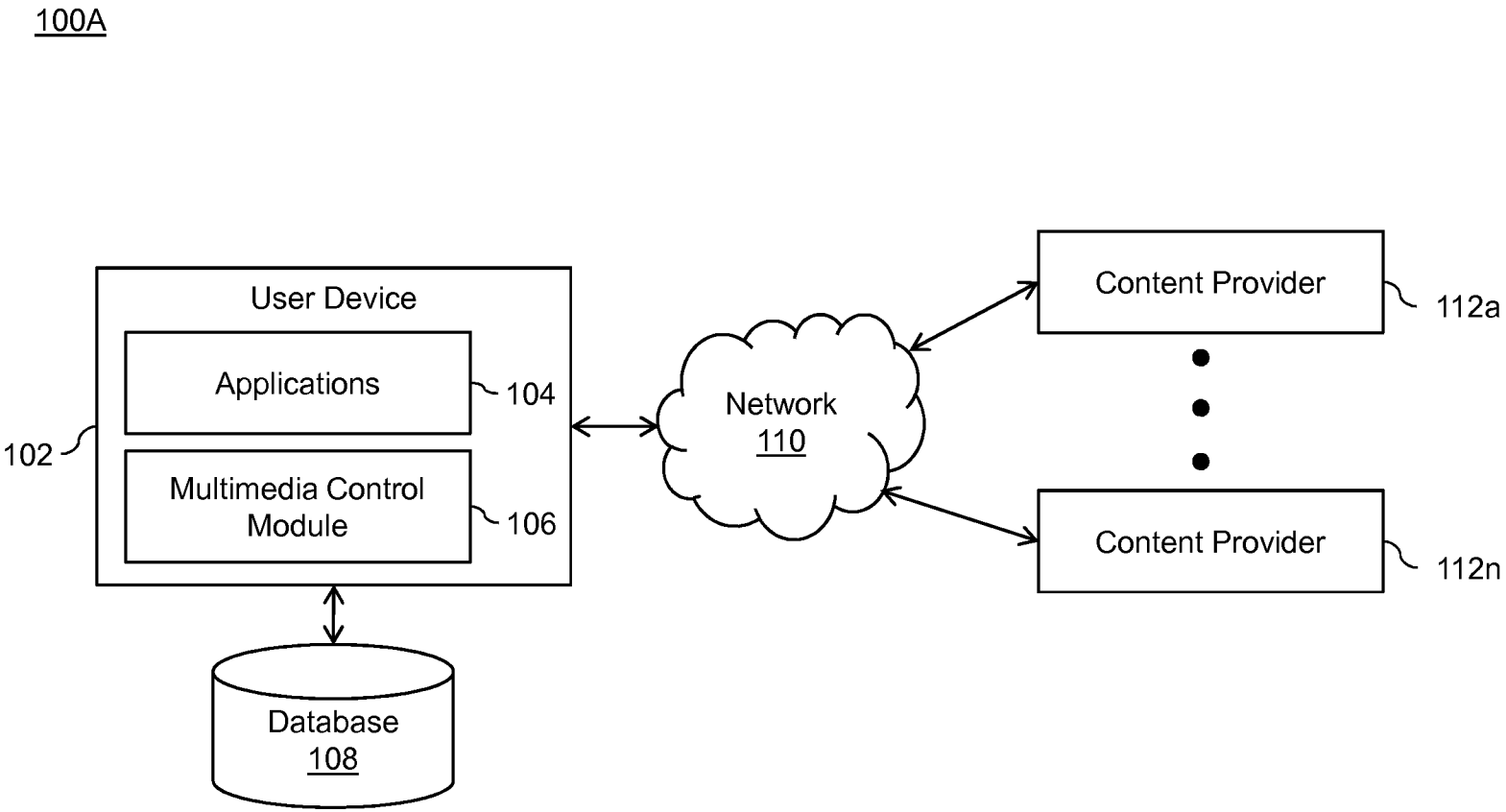
FIGS. 1A and 1B are diagrams of a system capable of controlling execution of multimedia on a user device, according to various embodiments.
Figure 1B:
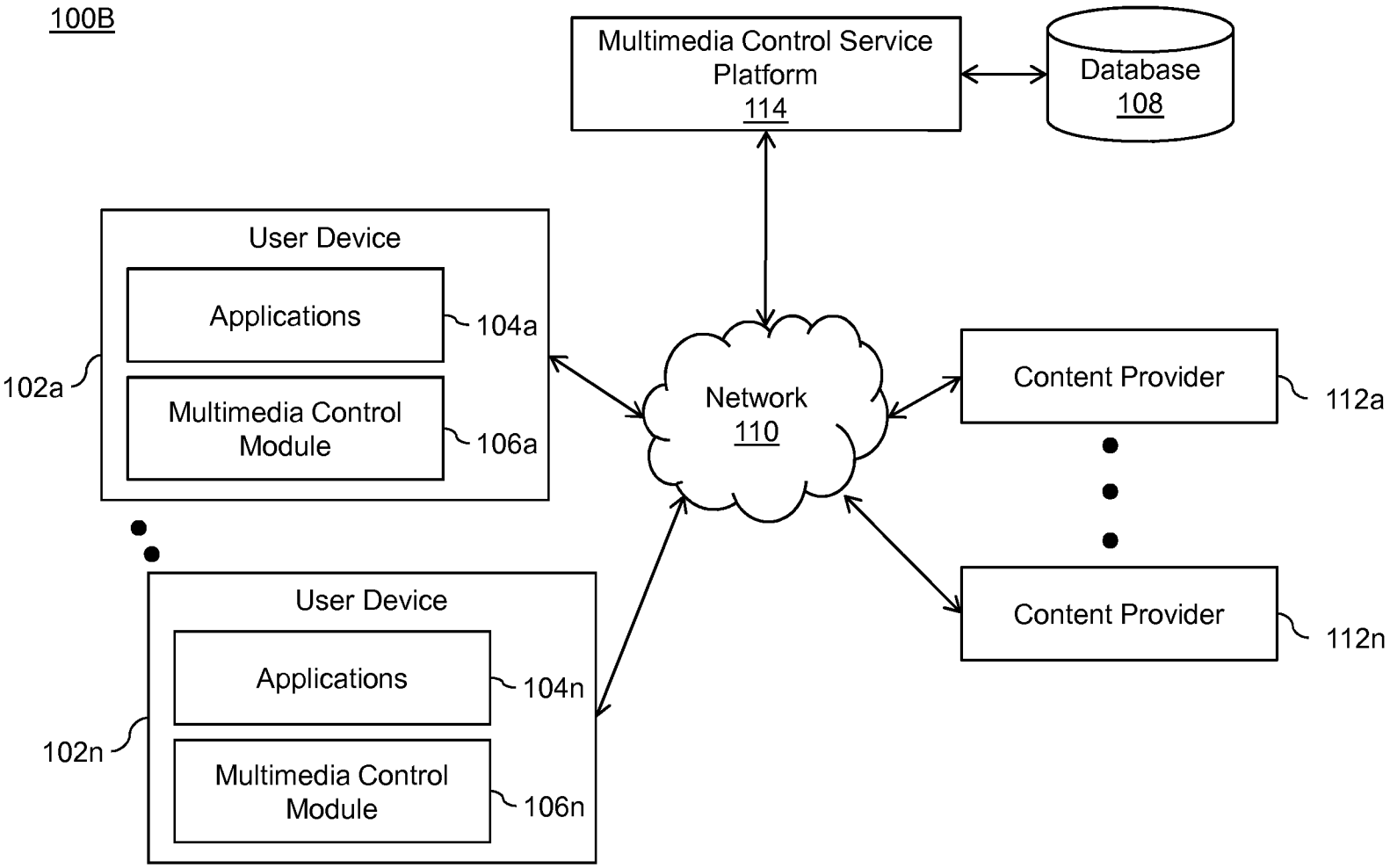

FIGS. 1A and 1B are diagrams of a system capable of controlling execution of multimedia on a user device, according to various embodiments. As shown in FIG. 1A, a system 100A comprises a user device 102 including a multimedia control module 106 for controlling execution of multimedia data. Examples of user device 102 may be, but not limited to a mobile device such as a cellular phone, a smartphone, a laptop, a personal computer, a television, personal digital assistants (PDAs), audio/video player, or any other device capable of playing audio data.

Generally, the multimedia data includes information such as audio data and/or video data. For example, the multimedia data may be in form of a video file or an audio file (e.g., mp3 file format, way file format, mpeg file format, etc.). In one embodiment, the multimedia data may be a data file stored on the user device 102 (e.g., an audio file). Typically, a multimedia data file includes one or more information blocks such as header information (e.g., album name, album artist, bitrate, author etc.), payload or audio content, etc. In another embodiment, the multimedia data may include audio signals such as digital and/or analog signals generated at the user device 102. For example, the digital or analog signals may be generated by a sound card on the user device 102. In yet another embodiment, the multimedia data may include audio data from streaming media received and/or transmitted over a network 110. Examples of the network 110 include any wired or wireless network, such as but not limited to, a Local Area Network (LAN), a Wide Area Network (WAN), a Wi-fi network, a cellular network and so forth. As shown, the multimedia data may be received at the user device 102 from one or more content provider 112*a-n* (collectively referred to as content providers 112). For example, the content providers 112 may include Internet audio, radio broadcast, etc.

In one embodiment, the user device 102 includes applications 104 for providing various services or functions (e.g., media playback, volume control, etc.). The multimedia control module 106 may communicate with the applications 104 to control the execution of the multimedia. By way of example, the execution of the multimedia data includes playback of the multimedia data, a distribution of the multimedia data, a reception of the multimedia data, or a combination thereof.

As noted above, the multimedia data may include audio data associated with one or more frequencies (e.g., 40 Hz, 7 Hz, etc.). The one or more frequencies may be presented as binaural beats that may relate to frequencies of brain. As a result, these frequencies presented as binaural beats may be harmful to a user of the user device 102. In an exemplary scenario, the multimedia data may include stereo audio sounds having two coherent sounds of nearly similar frequencies that are presented one to each ear of the user through stereo headphones or speakers of the user device 102. For example if a frequency of 300 Hz is played in one ear and a frequency of 307 Hz is played in the other ear, resulting in binaural beats of 7 Hz (i.e., a frequency difference of 7 Hz between the 307 Hz and 300 Hz frequencies). As noted previously, this frequency lies in one of the brain operation frequency and therefore may be harmful to the user. In one embodiment, the multimedia control module 106 controls the execution of the multimedia data on the user device 102 based on one or more frequency differences in the audio sound. The control of the execution of the multimedia data is associated with blocking the playback of the multimedia data, blocking the distribution of the multimedia data, blocking the reception of the multimedia data, allowing the playback of the multimedia data, allowing the distribution of the multimedia data, allowing the reception of the multimedia data, or a combination thereof. In one embodiment, the multimedia control module 106 may control the execution of the multimedia data based on certain binaural frequencies.

In one embodiment, one or more binaural beat parameters may be associated with the one or more frequency differences in the audio sounds of the multimedia data. For example, the binaural beat parameters may relate to a count of binaural beats (e.g., 10 binaural beats in the multimedia data), an intensity of binaural beats, a shape of binaural beat, a frequency of occurrence of binaural beat (e.g., 10 beats per second), or a combination thereof. In one embodiment, the multimedia control module 106 may control the execution of the multimedia data based on beat values of certain beat parameters. In one exemplary scenario, a multimedia file having 10 binaural beats per second may be blocked on the user device 102.

The multimedia control module 106 may communicate with a database 108 for controlling the execution of the multimedia data. In one embodiment, the database 108 may include prestored frequency values, prestored header values, prestored beat values, user profile or preferences etc. For example, the prestored frequency values may include one or more frequency values or a range of values that may relate to brainwave (e.g., 7 Hz or 4-7 Hz range). Similarly, the prestored header values may include, for example, name of an artist that relate to production of multimedia data having certain frequencies, and prestored beat values may include certain values of the one or more binaural beat parameters (e.g., 10 beats/sec). Further, the user profile or preference may include preferences set for/by the users (e.g., restricted playback time, parental controls, etc.).

As shown in FIG. 1B, a system 100B comprises a multimedia control service platform 114 for controlling the execution of the multimedia data. In one embodiment, the multimedia control service platform 114 provides the services for controlling the execution of the multimedia data on one or more user device 104*a-n* (collectively referred to as user device 104). In one scenario, the multimedia control service platform 114 performs all or some of the functions of the multimedia control module 106. In one embodiment, the multimedia control module 106 and the multimedia control service platform 114 may work together to control the execution of the multimedia data.

In one embodiment, the multimedia control service platform 114 may maintain the database 108. For example, the database 108 may be updated with the information related to the one or more prestored header values. In one embodiment, the multimedia control service platform 114 may control the execution of the multimedia data during transmission over the network 110. In one exemplary scenario, the multimedia data requested by a user from the content provider 112 may be processed by the multimedia control service platform 114 before transmitting to the user device 102.

Figure 2:
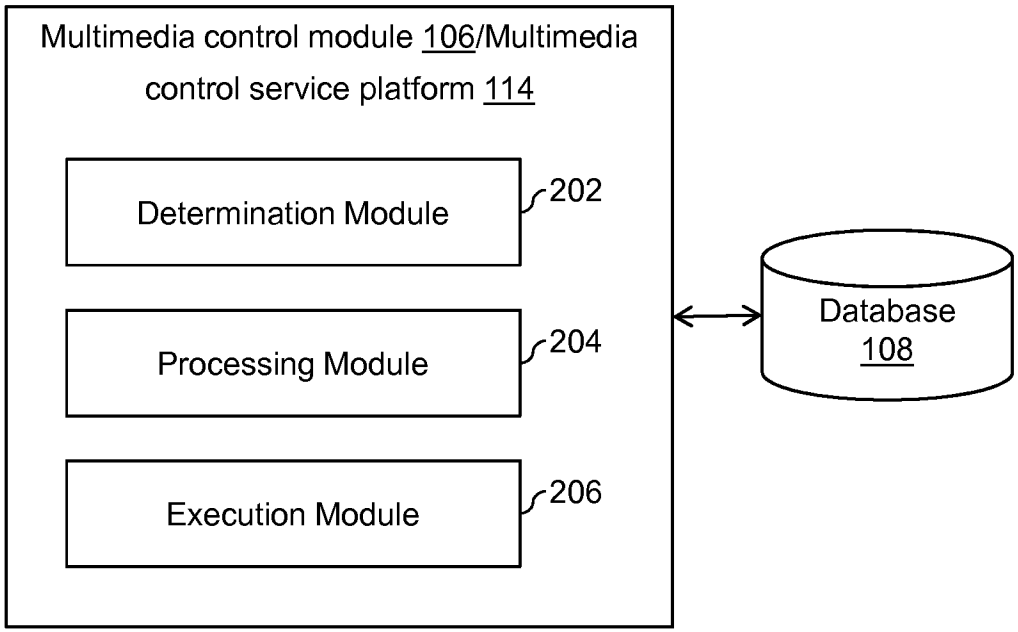
FIG. 2 is a diagram of the components of a multimedia control module/multimedia control service platform, according to an embodiment.

FIG. 2 is a diagram of the components of a multimedia control module 106/multimedia control service platform 114, according to an embodiment. In an embodiment, the multimedia control module 106/multimedia control service platform 114 includes a determination module 202, a processing module 204, and an execution module 206.

In an embodiment, the determination module 202 determines one or more information blocks of the multimedia data. In one embodiment, the one or more information blocks may relate to components of a multimedia data file (e.g., headers, payload, or other metadata information etc.), wherein the multimedia data includes audio sounds. For example, the one or more information blocks may be determined for a video data file stored on the user device 102. In one embodiment, the determination module 202 captures the multimedia data over a plurality of capture windows of a predefined time interval. For example, the multimedia data playing on the user device 102 (e.g., through a sound card) may be captured and stored and/or cached as the one or more information blocks over windows of predefined time interval (e.g., a new capture window after every 10 s of the multimedia data playback). In one embodiment, the predefined time interval may relate to a duration of the capture window (e.g., each window of 10 s duration may be captured). Further, in case, the multimedia data includes an encoded or encrypted audio file then the determination module 202 may determine the one or more information blocks based on capturing of the data, in an embodiment. For example, the audio file may be encrypted to hide the one or more header information values associated with the information blocks.

In one embodiment, the processing module 204 determines the one or more frequency differences in the audio sounds for each of the one or more information blocks of the audio data. Further, the processing module 204 determines one or more header information values associated with the one or more information blocks of the multimedia data. For example, a header information value such as a "name of artist" may be determined from the header of the multimedia data. Subsequently, the processing module 204 compares the header information values with the prestored header values. As noted previously, the prestored header values may be determined from the database 108. Accordingly, the execution module 206 may control the execution of the multimedia data based on the comparison of the one or more header information values to one or more prestored header values. For example, a song from an artist "X" may be blocked and/or an artist "Y" may be played on the user device 102. In one embodiment, various combinations of the header information values may be used to control the execution of the multimedia data. As noted previously, the execution of the multimedia data is associated with a playback of the multimedia data, a distribution of the multimedia data, a reception of the multimedia data, or a combination thereof. Further, the controlling of the execution of the multimedia data is associated with blocking the playback of the multimedia data, blocking the distribution of the multimedia data, blocking the reception of the multimedia data, allowing the playback of the multimedia data, allowing the distribution of the multimedia data, allowing the reception of the multimedia data, or a combination thereof.

As noted previously, the audio sounds may include stereo sound waves that may be presented through different sound path (e.g., one sound wave from a left earphone and another sound wave from a right earphone). In one embodiment, the processing module 204 processes the audio sounds of the multimedia data to generate a plurality of stereo sound waves of the audio sounds. In one embodiment, the stereo sound waves may be generated for each of the information blocks. Any known technique based on time or frequency analysis may be used for separation of stereo sounds. Thereafter, the processing module 204 determines the one or more frequency differences in the audio sounds for each of the one or more information blocks of the audio data. In one embodiment, the one or more frequency differences may be determined for information blocks associated with the stereo sound waves. Subsequently, the processing module 204 compares the one or more frequency differences with the prestored frequency values. As noted previously, the prestored frequency values may be determined from the database 108. Accordingly, the execution module 206 may control the execution of the multimedia data based on the comparison of the one or more frequency differences with the one or more prestored frequency values. For example, multimedia having frequency difference of 7 Hz may be blocked from playback on the user device 102.

In one embodiment, the processing module 204 determines one or more binaural beat parameters based, at least in part, on the one or more frequency differences in the audio sounds. As noted previously, the binaural beat parameters may relate to a count of binaural beats (e.g., 10 binaural beats in the multimedia data), an intensity of binaural beats (e.g., more than 10 dBm), a shape of binaural beat, a frequency of occurrence of binaural beat (e.g., 10 beats per second), or a combination thereof. Thereafter, the processing module 204 compares the one or more binaural beat parameters to one or more prestored beat values. As noted previously, the prestored beat values may be determined from the database 108. Accordingly, the execution module 206 may control the execution of the multimedia data based on the comparison of the one or more binaural beat parameters to the one or more prestored beat values. For example, a multimedia file having 10 binaural beats per second may be blocked on the user device 102. In one embodiment, the multimedia control module 106 may be implemented as a software plug-in for applications such as a web browser, multimedia application, multimedia streaming application (e.g., YouTube, etc.)

Figure 3:
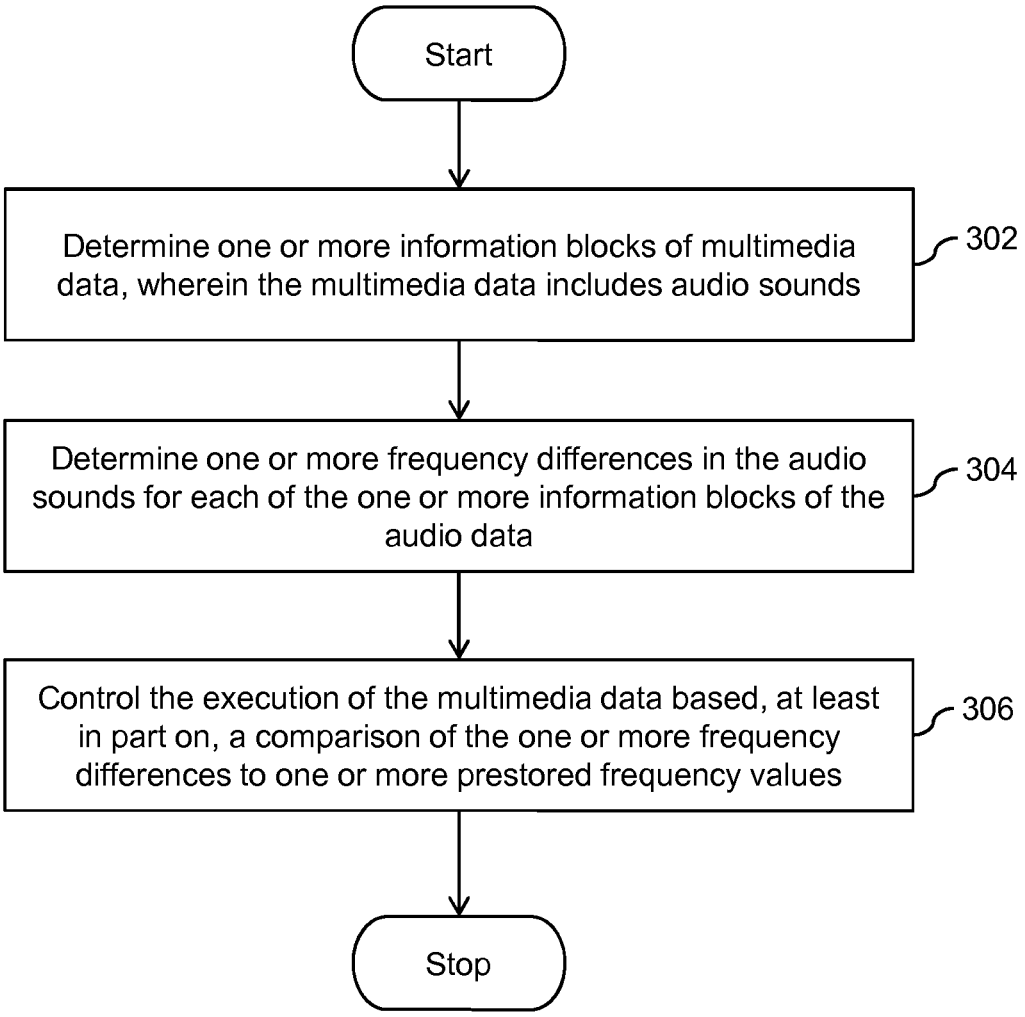
FIGS. 3, 4, an 5 are a flowchart of a process for controlling execution of multimedia on a user device, according to various embodiment.

FIG. 3 is a flowchart of a process for controlling execution of multimedia on a user device, according to an embodiment. In step 302, the multimedia control module 106 determines one or more information blocks of multimedia data, wherein the multimedia data includes audio sounds. As noted previously, the one or more information blocks may relate to components of a multimedia data file (e.g., headers, payload, or other metadata information etc.), wherein the multimedia data includes audio sounds. In one embodiment, the multimedia control module 106 determines the one or more information blocks based on capturing of the multimedia data over a plurality of capture windows of a predefined time interval. Further, the audio sounds may be processed in step 302 to generate a plurality of stereo sound waves of the audio sounds, in one embodiment.

In step 304, the multimedia control module 106 determines the one or more frequency differences in the audio sounds for each of the one or more information blocks of the audio data. In one embodiment, the one or more frequency differences in the audio sounds are based, at least in part, on the one or more frequency differences of the stereo sound waves. Subsequently, in step 306, the multimedia control module 106 controls the execution of the multimedia data based, at least in part on, a comparison of the one or more frequency differences to one or more prestored frequency values. As previously discussed, the multimedia control module 106 may determine the prestored frequency values from the database 108 for performing the comparison.

In one embodiment, the multimedia control module 106 compares the one or more header information values to one or more prestored header values to controlling the execution of the multimedia. As noted previously, the controlling the execution of the multimedia data is associated with blocking the playback of the multimedia data, blocking the distribution of the multimedia data, blocking the reception of the multimedia data, allowing the playback of the multimedia data, allowing the distribution of the multimedia data, allowing the reception of the multimedia data, or a combination thereof.

Figure 4:
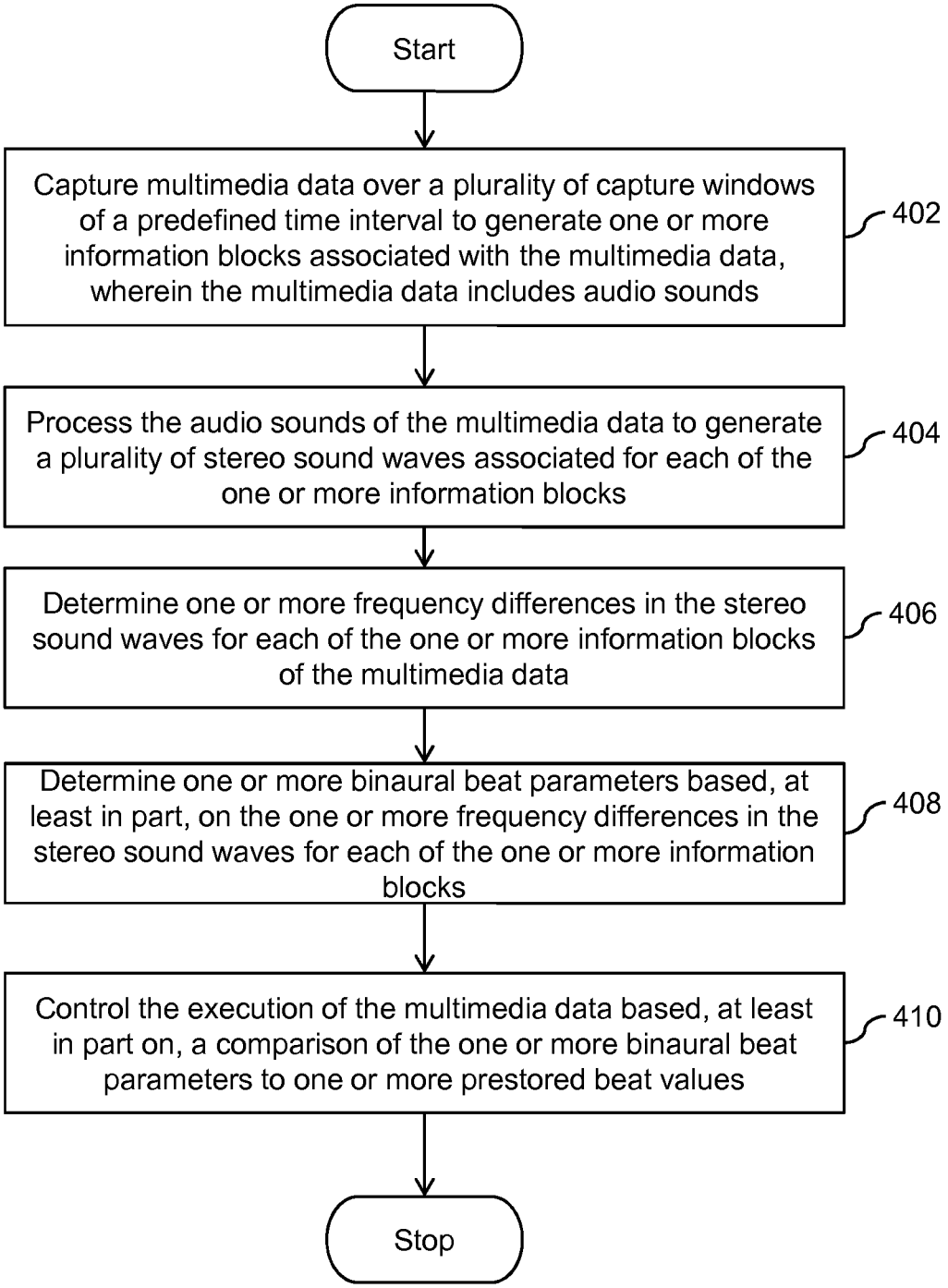

FIG. 4 is a flowchart of a process for controlling execution of multimedia on a user device, according to another embodiment. In step 402, the multimedia control module 106 captures multimedia data over a plurality of capture windows of a predefined time interval to generate one or more information blocks associated with the multimedia data, wherein the multimedia data includes audio sounds. For example, as noted previously, the multimedia data playing on the user device 102 (e.g., through a sound card) may be captured and stored and/or cached as the one or more information blocks over windows of predefined time interval (e.g., a new capture window after every 10 s of the multimedia data playback). In one embodiment, the predefined time interval may relate to a duration of the capture window (e.g., each window of 10 s duration may be captured).

In one embodiment, the multimedia control module 106 capture the multimedia data after it is determined that the header information is not available. For example, the multimedia data file may be encoded or encrypted to hide the header information, or the header information may be removed, etc.

In step 404, the multimedia control module 106 processes the audio sounds of the multimedia data to generate a plurality of stereo sound waves associated for each of the one or more information blocks. Thereafter, in step 406, the multimedia control module 106 determines one or more frequency differences in the stereo sound waves for each of the one or more information blocks of the multimedia data. As noted previously, any known audio processing technique may be implemented to detect the frequency differences.

In step 408, the multimedia control module 106 determines one or more binaural beat parameters based, at least in part, on the one or more frequency differences in the stereo sound waves for each of the one or more information blocks. As noted previously, the binaural beat parameters may relate to a count of binaural beats (e.g., 10 binaural beats in the multimedia data), an intensity of binaural beats, a shape of binaural beat, a frequency of occurrence of binaural beat (e.g., 10 beats per second), or a combination thereof.

Subsequently, in step 410, the multimedia control module 106 controls the execution of the multimedia data based, at least in part on, a comparison of the one or more binaural beat parameters to one or more prestored beat values. In one embodiment, the prestored beat values may be determined from the database 108. For example, if it is determined that the count of binaural beats is more than a prestored beat value, then the playback of the multimedia data may be blocked. In one embodiment, the multimedia control module 106 may block the distribution of multimedia data. For example, the multimedia data that includes binaural beats may be blocked from distribution over a network or to an external storage (e.g., a flash drive, a memory card, etc.).

Figure 5:
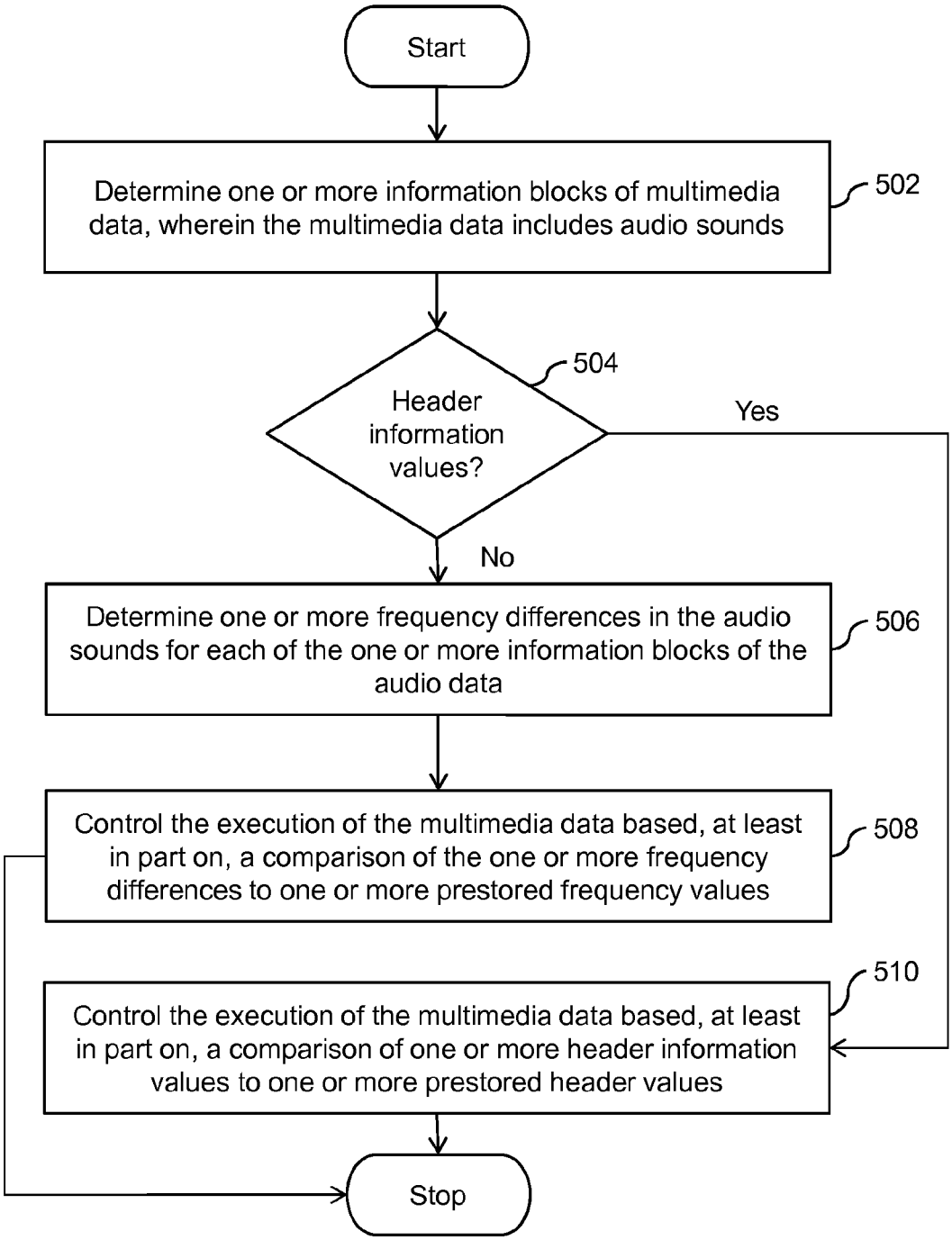

FIG. 5 is a flowchart of a process for controlling execution of multimedia on a user device, according to an embodiment. In step 502, the multimedia control module 106 determines one or more information blocks of multimedia data, wherein the multimedia data includes audio sounds. In one embodiment, the multimedia control module 106 determines one or more header information values associated with the one or more information blocks of the multimedia data. As noted previously, the header information may include information such as album name, album artist, bitrate, author, payload or audio content information, etc.

In step 504, if the multimedia control module 106 determines that header information values are available, then subsequently in step 510 the control the execution of the multimedia data based, at least in part on, a comparison of one or more header information values to one or more prestored header values. As noted previously, the prestored header values are determined from the database 108. Otherwise, in step 504, if the multimedia control module 106 determines that header information values are not available, then subsequently in step 506, the multimedia control module 106 determines one or more frequency differences in the audio sounds for each of the one or more information blocks of the audio data. For example, the header information may not be available for an encrypted multimedia data file, or for a multimedia data file in which the header is removed. In one embodiment, the multimedia control module 106 determines the one or more information blocks based on capturing of the multimedia data over a plurality of capture windows of a predefined time interval.

Subsequently, in step 508, the multimedia control module 106 controls the execution of the multimedia data based, at least in part on, a comparison of the one or more frequency differences to one or more prestored frequency values. As previously discussed, the multimedia control module 106 may determine the prestored frequency values from the database 108 for performing the comparison. As noted previously, the controlling the execution of the multimedia data is associated with blocking the playback of the multimedia data, blocking the distribution of the multimedia data, blocking the reception of the multimedia data, allowing the playback of the multimedia data, allowing the distribution of the multimedia data, allowing the reception of the multimedia data, or a combination thereof.

The processes described in FIGS. 3, 4, and 5 may be implemented as software, hardware, firmware or a combination thereof. Exemplary hardware to implement the processes may include, but are not limited to, processor(s), one or more Digital Signal Processor (DSP), one or more Application Specific Integrated Circuit (ASIC), one or more Field Programmable Gate Arrays (FPGAs), etc. Further, while the processes is FIGS. 3, 4 and 5 are explained with reference to multimedia control module 106, a person skilled in the art will appreciate, that these processes can be performed by the multimedia control service platform 114 alone or in combination with the multimedia control module 106. For example, the multimedia control module 106 may determine the multimedia data or one or more information blocks of the multimedia data, and the multimedia control service platform 114 may control the execution of the multimedia data.

Figure 6:
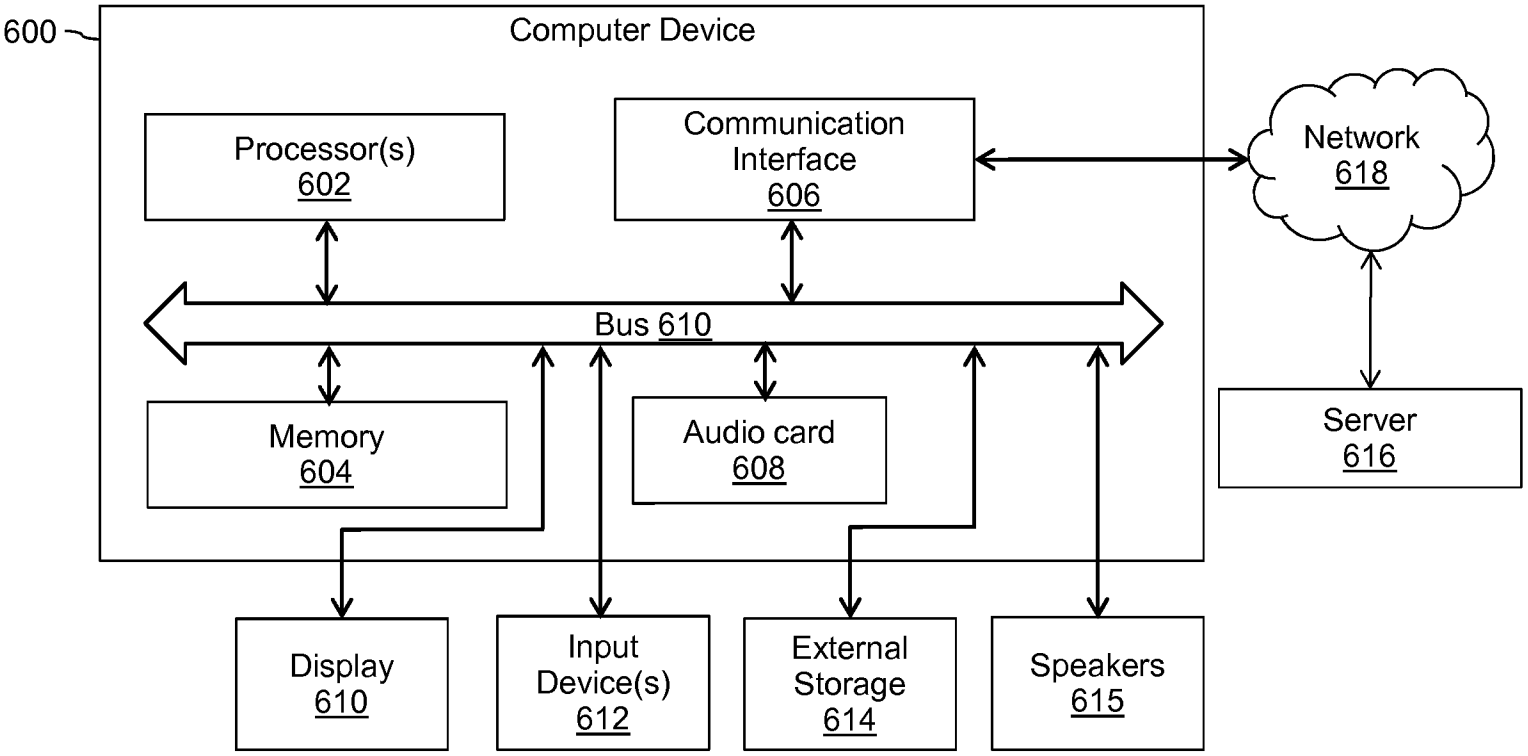
FIG. 6 is a computer device for controlling execution of multimedia, according to another embodiment.

FIG. 6 illustrates a computer device 600 upon which an embodiment of the invention may be implemented. As shown, the computer device 600 includes various components or hardware. In one embodiment, the computer device 600 includes a processor(s) 602, a memory 604, a communication interface 606, an audio/sound card 608, which communicate each other over a bus 610 (e.g., a serial or parallel bus). In one embodiment, the computer device 600 may be implemented as the user device 102, or in any other component or equipment shown in FIGS. 1A and 1B (e.g., servers, clients, etc.).

Further, the computer device 600 may communicate with external devices or components such as a display 610, input device(s) 612, external storage(s) 614, and/or speaker(s) 615. Also, the communication interface 606 may communicate to server(s) 616 over a network 618. Examples of network 618 include, but are not limited to, a Local Area Network (LAN), the Internet, a Wide Area Network (WAN), or any other wired or wireless network. Further, the communication interface 606 may communicate over the network 618 through various communication protocols such as Transport Control Protocol (TCP), User Datagram Protocol (UDP), Real Time Transport Protocol (RTP), etc. Further, the communication interface 606 may enable wireless communication by using technologies such as Bluetooth®, Near Field Communication (NFC), or by using any other protocol for transmitting data and/or signals etc.

Examples of memory 604 include, but are not limited to, a Read Only Memory (ROM), a Random Access Memory (RAM), a hard disk, a solid state disk, a magnetic disk, a tape drive, etc. The memory 604 may include instructions or software to perform the processes for controlling the execution of multimedia data. The instructions may be executed by the processor(s) 602. For example, audio sounds of the multimedia data may be captured by the audio card 608 and processed by the processor(s) 602. Further, the processor(s) 602 may process multimedia data stored in the memory 604 or on external storage 614, or received over input device(s) 614. In one embodiment, the processor(s) 602 may process the multimedia data being transmitted over the communication interface 606, or being received from the external storage 614. Examples of external storage 614 include, but are not limited to, a memory card, a flash drive, etc.

Input device(s) 612 (e.g., mouse, keyboard, microphone, etc.) may be used by a user to interact with the computer device 600. Examples of display 610 include, but are not limited to, an Light Emitting Display (LED), an Organic Light Emitting Display (OLED), a Cathode Ray Tube (CRT), or any other display interface for presenting multimedia content or information. Further, while not shown, the computer device 600 may include other hardware such as an Application Specific Integrated Circuit (ASIC), a Digital Signal Processors (DSP), etc.

The term "computer-readable medium" as used herein refers to any medium that participates in providing information to processor(s) 602, including instructions for execution. The term computer-readable storage medium is used herein to refer to any computer-readable medium except transmission media.

Figure 7:
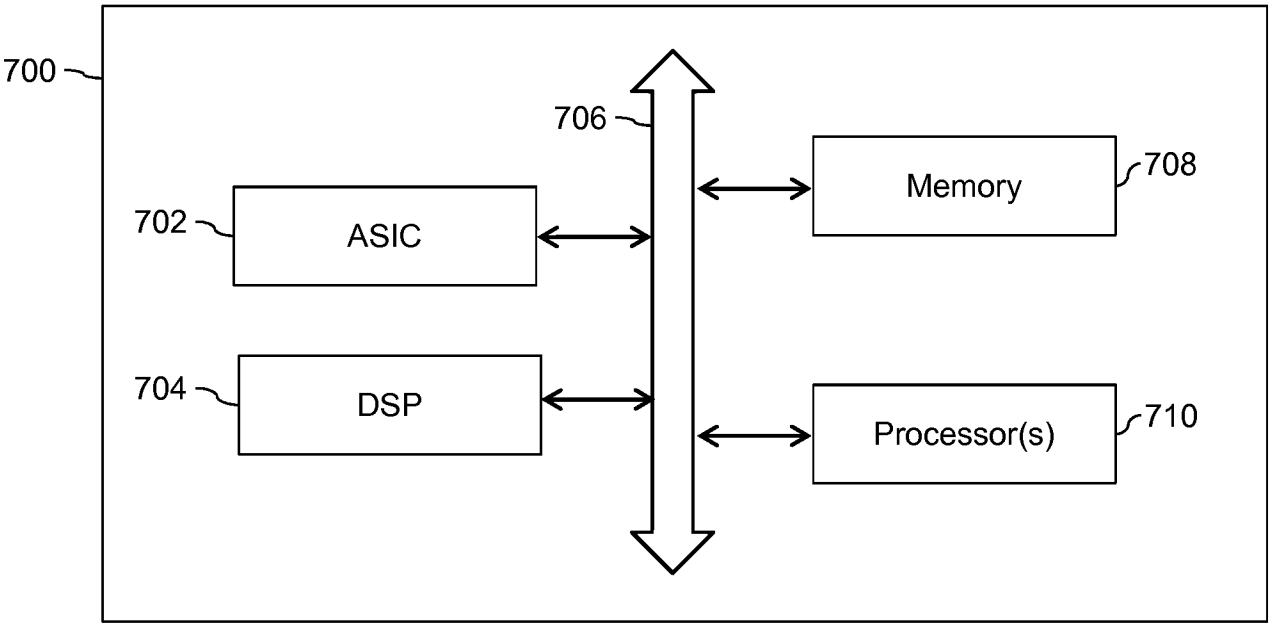
FIG. 7 is a diagram of a chip set that can be used to implement an embodiment of the invention, according to one embodiment.

FIG. 7 illustrates a chip or chip set 700 upon which an embodiment of the invention may be implemented. The chip set 700 may include components such as the processors and memory of as shown in FIG. 6. In one embodiment, the chip set 700 can be implemented as a System-on-Chip (SoC) or a single chip. As shown, the chip set 700 includes an ASIC 702, a DSP 704, a memory 708, and processor(s) 710. Further, the chip set 700 includes a bus 706 that enables communication of various components.

In one embodiment, the chip set 700 enables controlling of the execution of the multimedia data. The DSP 704 may process signals (e.g., sound) in real time. Similarly, the ASIC 702 can be configured to performed specialized functions not easily performed by a more general purpose processor. Other specialized components to aid in performing the inventive functions described herein may include one or more field programmable gate arrays (FPGA) (not shown), one or more controllers (not shown), or one or more other special-purpose computer chips. In one embodiment, the chip set 700 may implemented in the user device 102 (e.g., a mobile phone, or a music player).

Embodiments of the invention are described above with reference to block diagrams and schematic illustrations of methods and systems according to embodiments of the invention. It will be understood that each block of the diagrams and combinations of blocks in the diagrams can be implemented by computer program instructions. These computer program instructions may be loaded onto one or more general purpose computers, special purpose computers, or other programmable data processing translator to produce machines, such that the instructions which execute on the computers or other programmable data processing translator create means for implementing the functions specified in the block or blocks. Such computer program instructions may also be stored in a computer-readable memory that can direct a computer or other programmable data processing apparatus to function in a particular manner, such that the instructions stored in the computer-readable memory produce an article of manufacture including instruction means that implement the function specified in the block or blocks.

While the invention has been described in connection with what is presently considered to be the most practical and various embodiments, it is to be understood that the invention is not to be limited to the disclosed embodiments, but on the contrary, is intended to cover various modifications and equivalent arrangements included within the spirit and scope of the appended claims. The invention has been described in the general context of computing devices, phone and computer-executable instructions, such as program modules, being executed by a computer. Generally, program modules include routines, programs, characters, components, data structures, etc., that perform particular tasks or implement particular abstract data types. A person skilled in the art will appreciate that the invention may be practiced with other computer system configurations, including hand-held devices, multiprocessor systems, microprocessor-based or programmable consumer electronics, network PCs, minicomputers, mainframe computers, and the like. Further, the invention may also be practiced in distributed computing worlds where tasks are performed by remote processing devices that are linked through a communications network. In a distributed computing world, program modules may be located in both local and remote memory storage devices.

This written description uses examples to disclose the invention, including the best mode, and also to enable any person skilled in the art to practice the invention, including making and using any devices or systems and performing any incorporated methods. The patentable scope the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method comprising:

capturing multimedia data over a plurality of capture windows of a predefined time interval to generate one or more information blocks associated with the multimedia data, wherein the multimedia data includes audio sounds;

processing the audio sounds of the multimedia data to generate a plurality of stereo sound waves for each of the one or more information blocks;

determining one or more frequency differences in the stereo sound waves for each of the one or more information blocks of the multimedia data; and controlling an execution of the multimedia data based, at least in part on, a comparison of the one or more frequency differences to one or more prestored frequency values.

2. The method of claim 1, further comprising:

determining one or more header information values associated with the one or more information blocks of the multimedia data, wherein the controlling the execution of the multimedia data is based, at least in part on, a comparison of the one or more header information values to one or more prestored header values.

3. The method of claim 1, wherein the execution of the multimedia data is associated with a playback of the multimedia data, a distribution of the multimedia data, a reception of the multimedia data, or a combination thereof.

4. The method of claim 3, wherein the controlling the execution of the multimedia data is associated with blocking the playback of the multimedia data, blocking the distribution of the multimedia data, blocking the reception of the multimedia data, allowing the playback of the multimedia data, allowing the distribution of the multimedia data, allowing the reception of the multimedia data, or a combination thereof.

5. The method of claim 1, wherein the multimedia data includes an encoded audio file.

6. The method of claim 1, further comprising:

determining one or more binaural beat parameters based, at least in part, on the one or more frequency differences in the stereo sound waves, wherein the controlling the execution of the multimedia data is based, at least in part on, a comparison of the one or more binaural beat parameters to one or more prestored beat values.

7. The method of claim 6, wherein the binaural beat parameters are associated with a count of binaural beats, an intensity of binaural beats, a shape of binaural beat, a frequency of occurrence of binaural beat, or a combination thereof.

8. A method comprising:

capturing multimedia data over a plurality of capture windows of a predefined time interval to generate one or more information blocks associated with the multimedia data, wherein the multimedia data includes audio sounds;

processing the audio sounds of the multimedia data to generate a plurality of stereo sound waves associated for each of the one or more information blocks;

determining one or more frequency differences in the stereo sound waves for each of the one or more information blocks of the multimedia data;

determining one or more binaural beat parameters based, at least in part, on the one or more frequency differences in the stereo sound waves for each of the one or more information blocks; and controlling an execution of the multimedia data based, at least in part on, a comparison of the one or more binaural beat parameters to one or more prestored beat values.

9. The method of claim 8, wherein the binaural beat parameters are associated with a count of binaural beats, an intensity of binaural beats, a shape of binaural beat, a frequency of occurrence of binaural beat, or a combination thereof.

10. The method of claim 8, wherein the multimedia data includes an encoded audio file.

11. The method of claim 8, wherein the execution of the multimedia data is associated with a playback of the multimedia data, a distribution of the multimedia data, a reception of the multimedia data, or a combination thereof.

12. The method of claim 8, wherein the controlling the execution of the multimedia data is associated with blocking the playback of the multimedia data, blocking the distribution of the multimedia data, blocking the reception of the multimedia data, allowing the playback of the multimedia data, allowing the distribution of the multimedia data, allowing the reception of the multimedia data, or a combination thereof.

13. An apparatus comprising:

a processor;

a memory coupled with the processor, wherein the memory comprises one or more instructions that cause the processor to perform at least:

capture multimedia data over a plurality of capture windows of a predefined time interval to generate one or more information blocks associated with the multimedia data, wherein the multimedia data includes audio sounds;

process the audio sounds of the multimedia data to generate a plurality of stereo sound waves associated for each of the one or more information blocks;

determine one or more frequency differences in the stereo sound waves for each of the one or more information blocks of the multimedia data; and control an execution of the multimedia data based, at least in part on, a comparison of the one or more frequency differences to one or more prestored frequency values.

14. The apparatus of claim 13, wherein the apparatus is further caused to:

determine one or more header information values associated with the one or more information blocks of the multimedia data, wherein the control of the execution of the multimedia data is based, at least in part on, a comparison of the one or more header information values to one or more prestored header values.

15. The apparatus of claim 13, wherein the apparatus is further caused to:

determine one or more binaural beat parameters based, at least in part, on the one or more frequency differences in the stereo sound waves, wherein the control of the execution of the multimedia data is based, at least in part on, a comparison of the one or more binaural beat parameters to one or more prestored beat values.

16. The apparatus of claim 15, wherein the binaural beat parameters are associated with a count of binaural beats, an intensity of binaural beats, a shape of binaural beat, a frequency of occurrence of binaural beat, or a combination thereof.

17. The apparatus of claim 13, wherein the execution of the multimedia data is associated with a playback of the multimedia data, a distribution of the multimedia data, a reception of the multimedia data, or a combination thereof.

18. The apparatus of claim 13, wherein the controlling the execution of the multimedia data is associated with blocking the playback of the multimedia data, blocking the distribution of the multimedia data, blocking the reception of the multimedia data, allowing the playback of the multimedia data, allowing the distribution of the multimedia data, allowing the reception of the multimedia data, or a combination thereof.

* * * * *